US006059466A

United States Patent [19]

Negoro

[11] Patent Number: 6,059,466

[45] Date of Patent: May 9, 2000

[54] PHOTOGRAPHIC FILM AUTOMATIC DEVELOPING APPARATUS

[75] Inventor: Hisashi Negoro, Wakayama, Japan

[73] Assignee: Noritsu Koki Co., Ltd., Wakayama, Japan

[21] Appl. No.: 09/247,283

[22] Filed: Feb. 9, 1999

[30] Foreign Application Priority Data

Feb. 9, 1998 [JP] Japan ..... 10-027534

[51] Int. Cl.[7] ..... G03D 3/08

[52] U.S. Cl. ..... 396/612; 396/617; 396/620

[58] Field of Search ..... 396/567, 568, 396/570, 598, 599, 612, 617, 620, 622

[56] References Cited

U.S. PATENT DOCUMENTS

| | | | |
|---|---|---|---|
| 4,416,529 | 11/1983 | Kastl | 354/320 |
| 5,430,520 | 7/1995 | Toki et al. | 396/612 |
| 5,523,817 | 6/1996 | Morita | 354/319 |
| 5,541,042 | 7/1996 | Ura et al. | 396/617 |

FOREIGN PATENT DOCUMENTS

| | | |
|---|---|---|
| 0626619 | 11/1994 | European Pat. Off. . |
| 2678747 | 1/1993 | France . |

*Primary Examiner*—Alan A. Mathews
*Attorney, Agent, or Firm*—Smith Patent Office

[57] ABSTRACT

A leader-less type photographic film automatic developing apparatus is described which provides for a maximally narrowed spacing between the centers of the development lines for respective films which can develop a plurality of kinds of film having different widths such as a 135 size film and an APS film. The apparatus includes a first development line for drawing a 135 size film from a film cartridge or the like and developing it, and a second development line for drawing an APS film from a special magazine and developing it. These lines are arranged in parallel to each other. The film cartridge and the special magazine are mounted on a common container holding table which is movable along a direction normal or oblique to the direction of the development lines.

7 Claims, 7 Drawing Sheets

PHOTOGRAPHIC FILM AUTOMATIC DEVELOPING APPARATUS

BACKGROUND OF THE INVENTION

1. Field of the Invention

The present invention relates to a photographic film automatic developing apparatus which can develop both a 135 size film and an APS (advanced photo system) film and particularly to a leader-less type developing apparatus.

2. Discussion of the Related Art

In recent years, with the spread of APS cameras, APS films as well as 135 size films are developed not only at special photo laboratories, but also at photo finishing shops. For example, in a conventional photographic film automatic developing apparatus provided with a leader which is used at photo laboratories, the leading end of the film is fixed to a leader having a larger width than the film by an adhesive tape or other means, and the film following the leader is developed while the leader is transported along a specified film transport path provided in the development apparatus. Accordingly, any film having a narrower width than the leader can be developed. For example, a 135 size film and an APS film can be simultaneously developed by being arranged side by side.

On the other hand, at photo finishing shops, operators are often unaccustomed to handling and developing film. Thus, easy handling of the apparatus is very important. Therefore, in a photographic film automatic developing apparatus installed at a photo finishing store, the step of fixing the leading end of the film to the leader is omitted. For example, in the case of 135 size film, the apparatus is constructed such that a film cartridge (e.g., a metal case already containing film when shipped from the manufacturer) is directly mounted; the film is automatically drawn from the film cartridge; and the film is fed to a developer after the rear end of the film is cut off. This type of apparatus is referred to as a leader-less type. In the leader-less type apparatus, for example, opposite sides 3*b* of the film 3 are guided along guide grooves 35 and the film 3 (3A, 3B) is transported along a specified film transport path by transport rollers 36 as shown in FIG. 6.

In the APS, a film cartridge (i.e., a resin case already containing film when shipped from the manufacturer) is used not only to prevent undeveloped film from being exposed to light, but also to store the film after development. In other words, the film is stored in the film cartridge again after development and, accordingly, the film cartridge cannot be disposed. Therefore, in a dark room or the like, the APS film is transferred to a special magazine, which is then mounted in the photographic film automatic developing apparatus.

Since the APS film has a narrower width than the 135 size film, the opposite sides thereof cannot be guided by the guide grooves 35. Thus, the film cannot be transported along the film transport path during the development process in a development line made for 135 size film. Thus, if an attempt is made to develop both the 135 size films and the APS films in the leader-less type photographic film developing apparatus, special development lines for the respective types of films are required.

On the other hand, in the case of the 135 size film 3A, an end 1*a* of a spool shaft projects from a film cartridge 1 as shown in FIG. 9, and the maximum width D1 of the film cartridge 1 is considerably larger than the actual width W1 of the film 3A (the maximum width of the cartridge is about 48 mm as compared to the film width of 35 mm). In the case of the APS film 3B, a special magazine 2 can be designed in a desired size in order to conform with the photographic film automatic developing apparatus. For example, in the case of mass production by resin molding, a maximum width D2 of the special magazine 2 has to be larger than a width W2 (24 mm) of the film 3B since the respective portions need to have a specified thickness.

Here, if the development lines for the 135 size film and the APS film are arranged side by side, the spacing S1 between center lines L1 and L2 of the respective development lines is given by following equation (1) assuming that G1 denotes thickness of the wall between the respective development lines:

$$S1=(D1+D2)/2+G1 \quad (1)$$

Specifically, the spacing S1 between the center lines L1 and L2 cannot be reduced below a specified value by being restricted by the maximum widths D1, D2 of the film cartridge 1 and the special magazine 2. This problem not only increases dead space in the widthwise direction of the developing apparatus, but also causes the problem of increased capacities required for the respective treatment tanks in the development process as well as the problem of increased waste fluid.

SUMMARY OF THE INVENTION

The present invention was developed to solve the above and other problems. Accordingly, an object of the invention is to provide a photographic film automatic developing apparatus which can develop multiple kinds of films having different widths such as 135 size film and APS film, and in which spacing between center lines of development lines for the respective films can be as narrow as possible.

In order to accomplish the above and other objects, the present invention is directed to a photographic film automatic developing apparatus, comprising:

- a first development line for drawing a first type of film from a first film container and developing it, and
- a second development line for drawing a second type of film having a narrower width than the first type of film from a second film container and developing it,
- wherein at least the first and second development lines are arranged in parallel to each other, and the first and second film containers are mounted on a common container holding table which is movable along a direction oblique and preferably normal to the extension of the first and second development lines in the moving direction.

With this construction, necessary spacing between the center lines of the first and second development lines can be minimized even though the first and second film containers cannot simultaneously be mounted. As a result, the width (in the direction normal to the direction of transport of the film) of the developing apparatus can be made smaller as compared to the case where the first and second film containers are simply arranged side by side. Accordingly, dead space in the widthwise direction of the developing apparatus can be reduced, and the size of the respective treatment tanks and the amount of waste fluid during the development process can be minimized.

In the above apparatus, the container holding table may comprise a click-stop mechanism so as to stop transport at a first position where the center line of the first kind of film contained in the first film container is in alignment with the center line of the first development line. The container holding table may also stop in a second position where the center line of the second kind of film contained in the second container is in alignment with the center line of the second development line. Such a construction makes it easier to position the container holding table and enables smooth film development even when developing both the first and second kinds of films.

In the above embodiments, the first and second development lines may preferably contain film transport paths possessing guide grooves for guiding the opposite sides of the first and second kinds of film and film transport rollers for coming into contact with image recording areas of the first and second kinds of films to transport them in specified directions, respectively. This structure enables the film to be securely transported to the development process without using a leader.

The first development line may preferably comprise two film detection sensors for detecting the presence of the opposite sides of the first kind of film. With this arrangement, even if a second kind of film having a narrower width is mistakenly mounted in the first development line intended for the first kind of film, the erroneous film mounting can be detected since the two film detection sensors cannot simultaneously detect the side edges of the film.

In the above embodiments, the maximum dimensions of the first and second film containers in at least the moving direction of the container holding table are preferably substantially equal. Such a design enables the first and second film containers to be held stably by the container holding table.

In the above embodiments, the container holding table may preferably comprise a fixing member for fixing at least one of either the fist and second film containers. With this arrangement, movement of the film container due to the elasticity of the film can be controlled even if the ends of the films drawn from the respective film containers are curled.

DETAILED DESCRIPTION OF THE PREFERRED EMBODIMENTS

Figure 1:
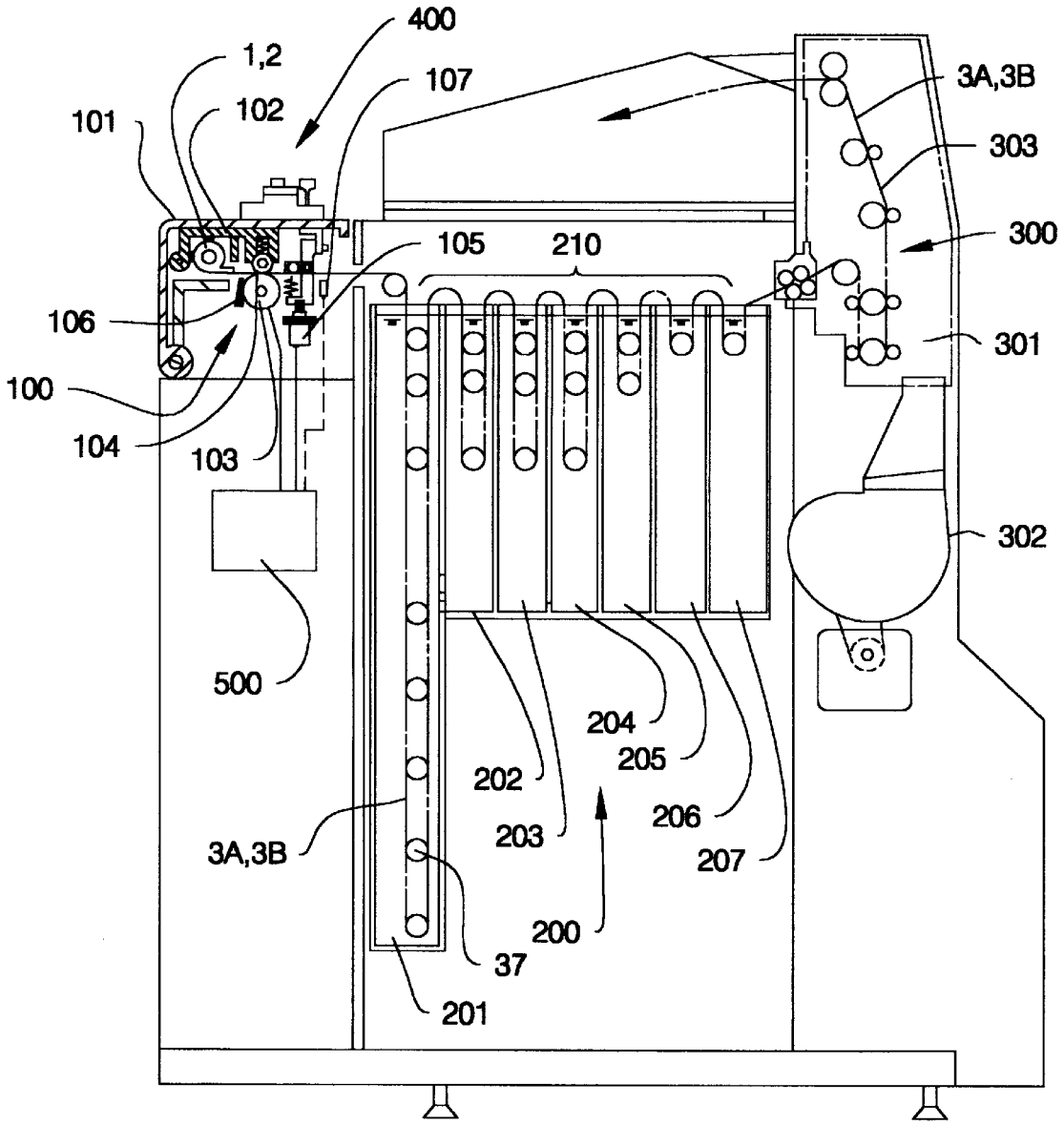
FIG. 1 is a section showing the schematic construction of one embodiment of the photographic film automatic developing apparatus according to the invention.

An embodiment of the invention is described with reference to FIGS. 1 to 7. As shown in FIG. 1, a development line of the developing apparatus according to this embodiment is composed of a film draw-out assembly 100 for drawing films 3A, 3B from a film cartridge 1 and a special magazine 2, a developing assembly 200 for developing the drawn films 3A, 3B, a drying assembly 300 for drying the developed films, a film end processing assembly 400 flattening ends of the film 3A or 3B to be developed, and a controller 500 for controlling the film draw-out assembly 100, the developing assembly 200, the drying assembly 300, etc. A plurality of development lines (e.g. 2 lines) is provided in a direction normal to the plane of FIG. 1.

As also shown in FIG. 1, the film draw-out assembly 100 is provided with an outer cover 101 which serves also as the exterior of the developing apparatus, an inner cover 102 which functions as a holder for holding the film cartridge 1 or the special magazine 2, film transport rollers 103, driven rollers 104, a cover locking mechanism 105 for locking the outer cover 101, a cutter 106, film detection sensors 107, etc. The film transport rollers 103 and the driven rollers 104 draw the films 3A and 3B from the film cartridge 1 and the special magazine 2 while nipping the leading ends of the films 3A, 3B drawn out from the film cartridge 1 and the special magazine 2, and conveying the films 3A, 3B to the developing assembly 200. The cutter 106 cuts the rear end of the film (e.g. the 135 size film) to separate the film 3A from the film cartridge 1.

The film detection sensors 107 detect the passage of the leading and trailing ends of the films 3A and 3B. The cutter 106 is not provided in the development line L2 for the APS film 3B. The film transport rollers 103 are rotated in a specified direction by a motor or other means to transport the films 3A and 3B to the developing assembly 200 along guide grooves 35. The driven rollers 104 are held inside the inner cover 102 and press the films 3A and 3B against the film transport rollers 103 with the inner cover 102 closed.

Figure 6:
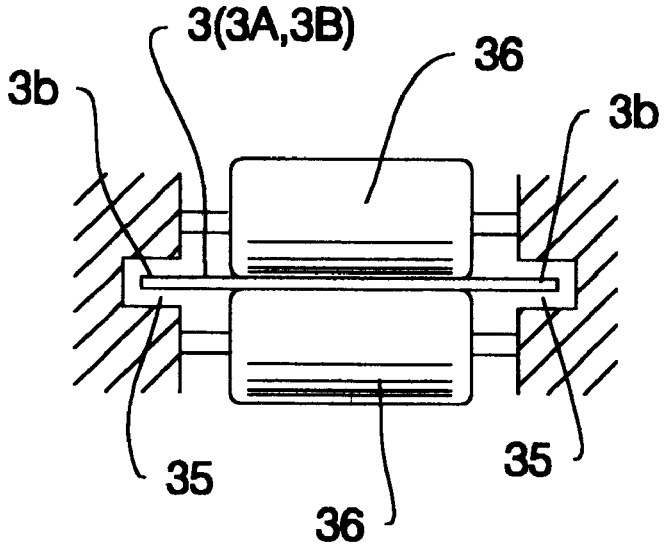
FIG. 6 is an enlarged view showing the film passing between the rollers and extending into the guide grooves.
Figure 7:
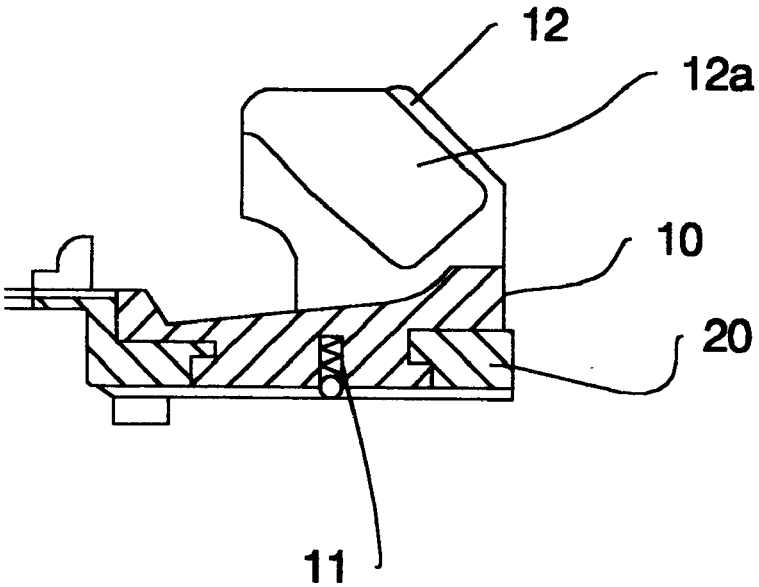
FIG. 7 is an enlarged view showing the right wall of a container holding table of the film draw-out assembly.

The developing assembly 200 is provided with a developing treatment tank 201 filled with developer, a bleaching treatment tank 202 filled with bleach liquid, fixing treatment tanks 203, 204 filled with fixer and stabilizing treatment tanks 205, 206, 207 filled with stabilizer and transport rollers 37. Inside and above the respective treatment tanks 201 to 207, a film transport path 210 is formed by guide walls 35, transport rollers 36, etc. as shown in FIG. 6.

The drying assembly 300 is provided with a drying chamber 301 for drying the developed film, a blower 302 for blowing hot air into the drying chamber 301, a transport path 303 for transporting the films 3A, 3B, and the like.

Figure 2:
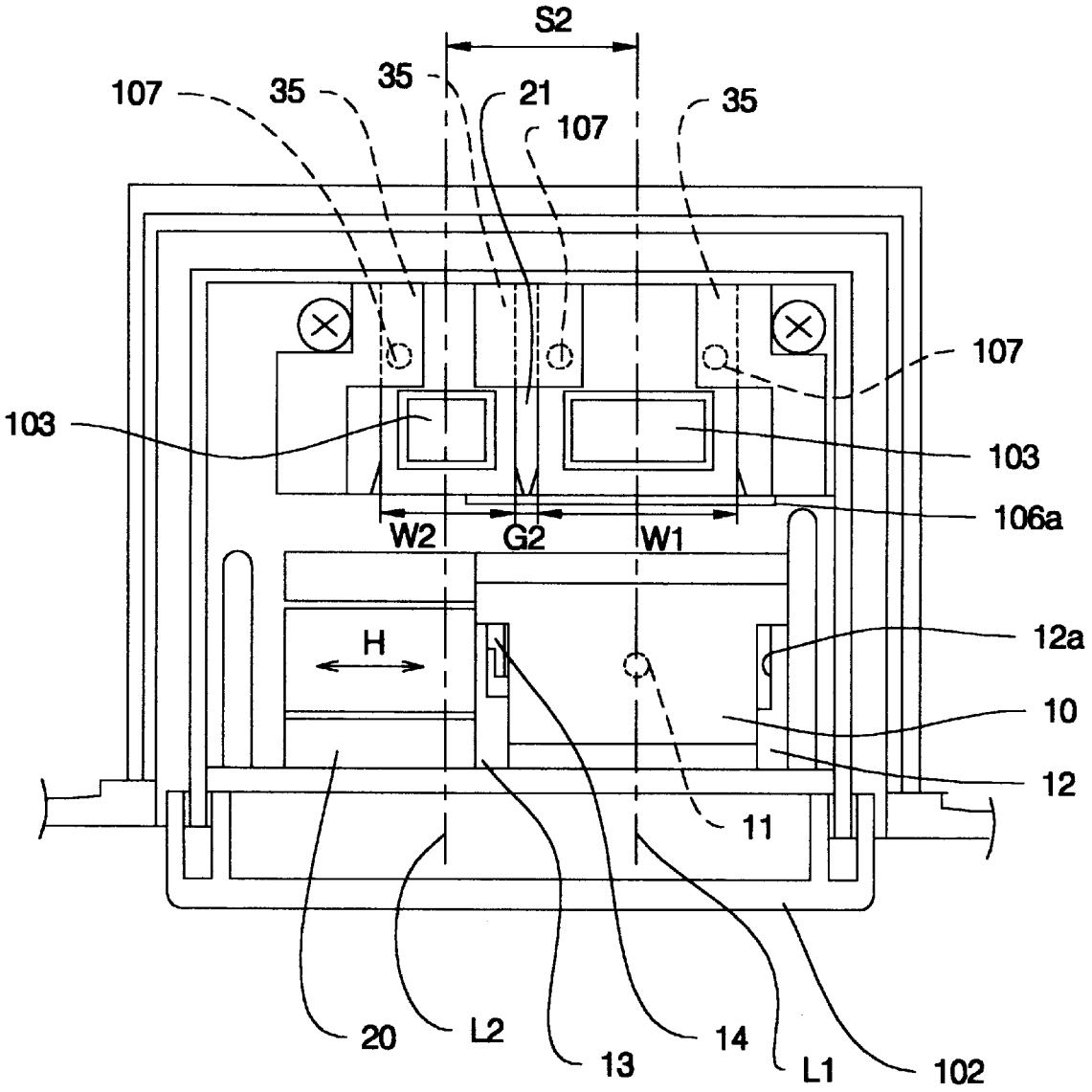
FIG. 2 is a plan view showing the structure of film draw-out assembly in the apparatus of FIG. 1.
Figure 3:
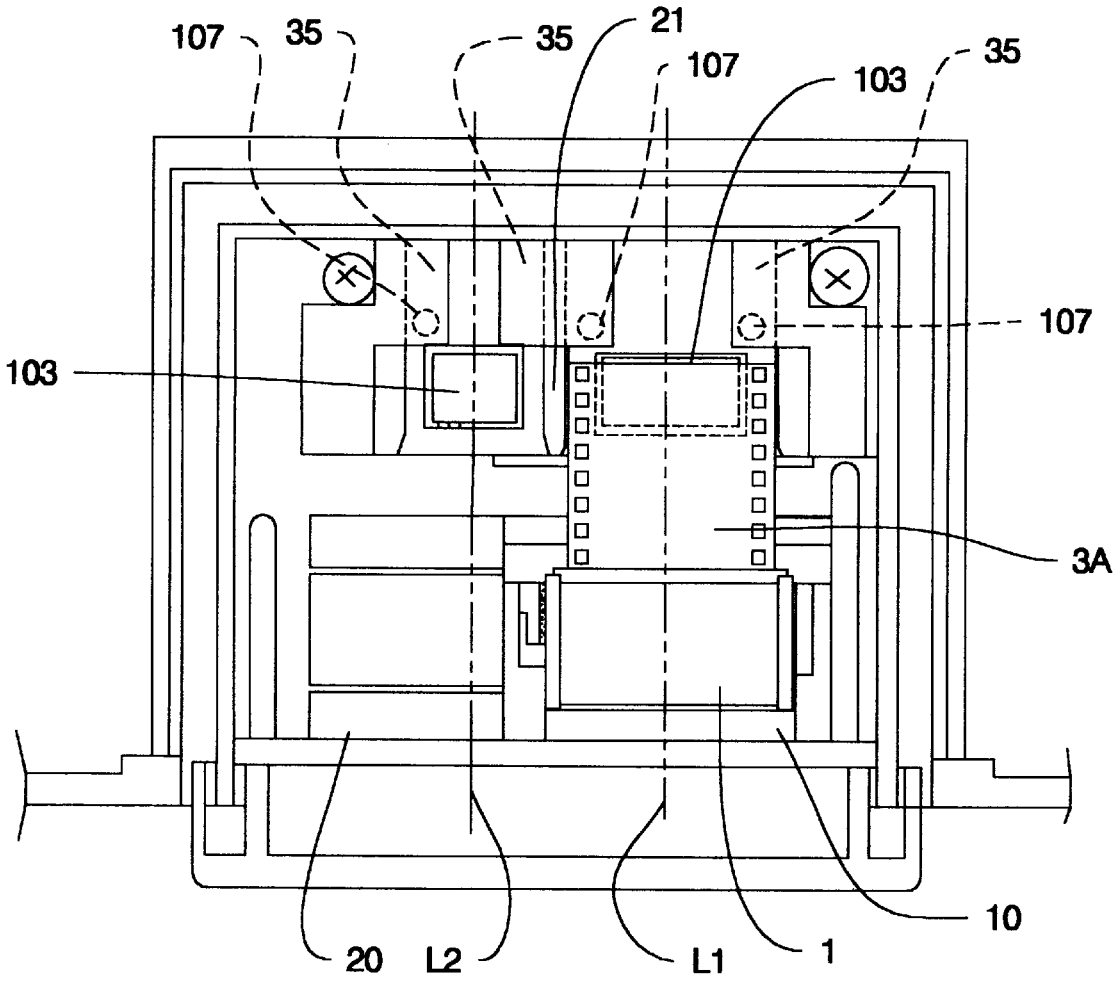
FIG. 3 is a plan view showing a 135 size film loaded in the film draw-out assembly.
Figure 4:
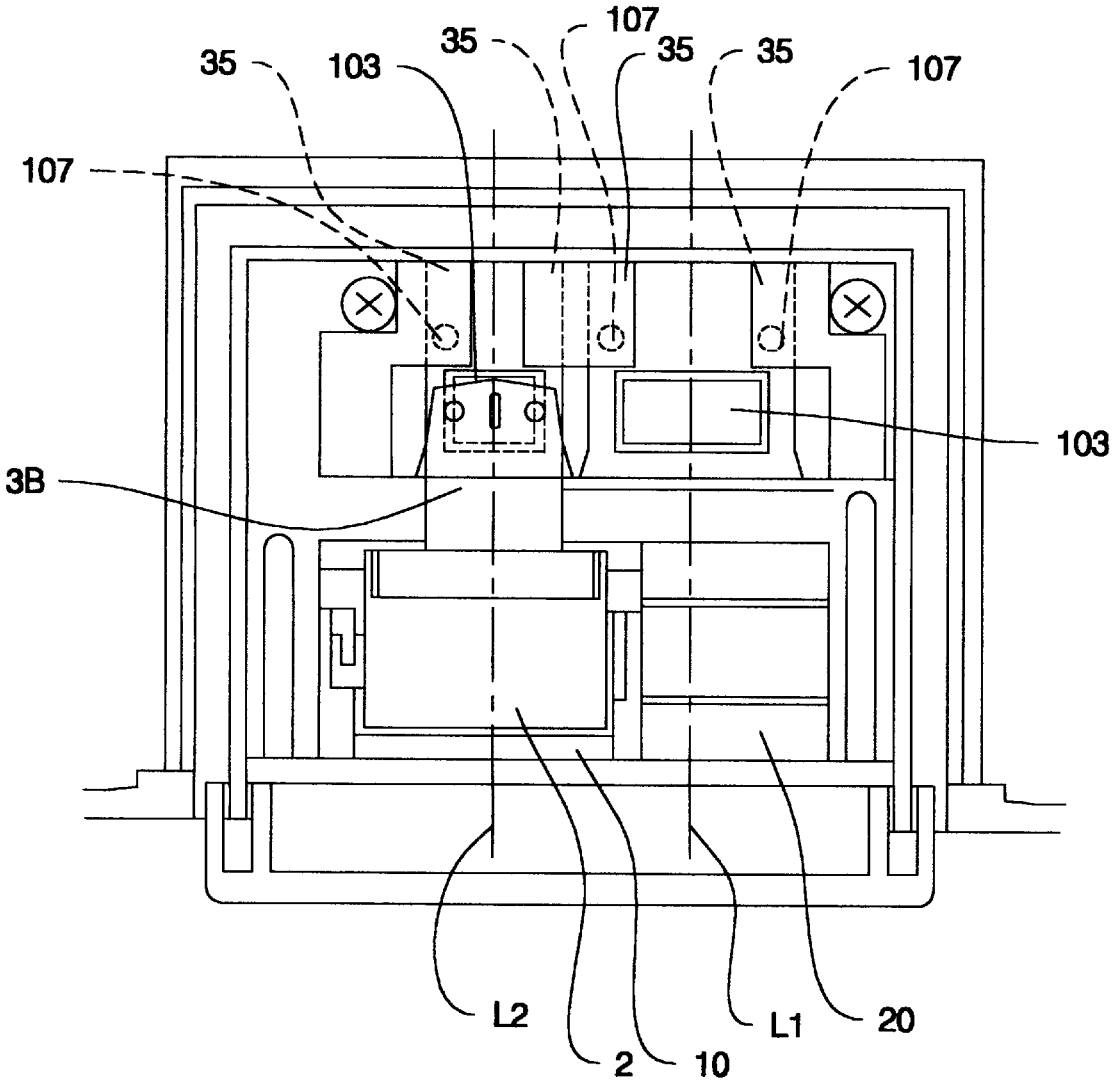
FIG. 4 is a plan view showing an APS film loaded in the film draw-out assembly.
Figure 5:
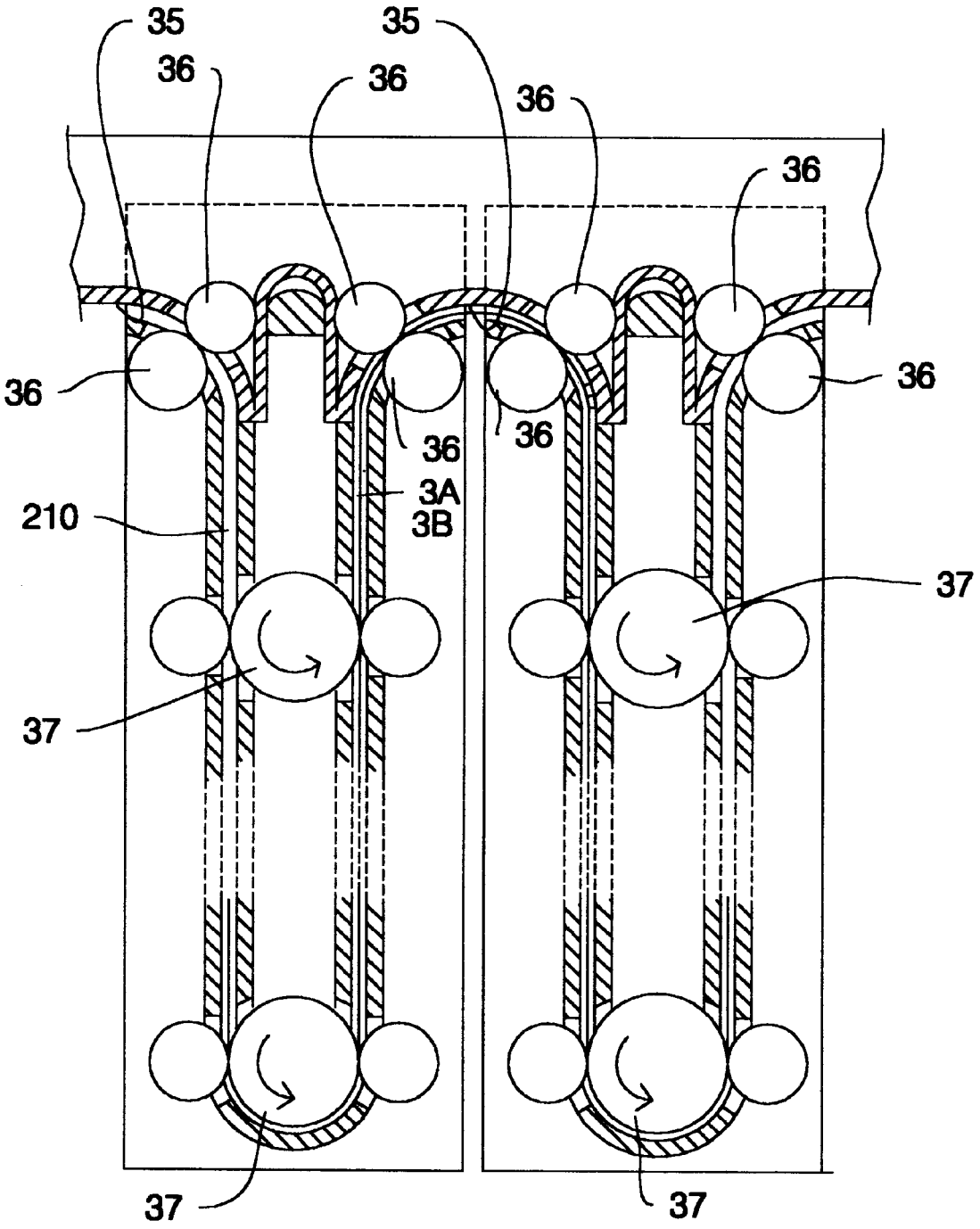
FIG. 5 is a view showing the film transport path in a developing assembly.

As shown in FIGS. 2 to 4, in this embodiment, a first development line (center line L1) on the right side is the one for the 135 size film 3A (an example of a first kind of film) (hereinafter, "development line L1"). A second development line (center line L2) is the one for the APS film 3B (an example of a second kind of film) (hereinafter, "development line L2"). A guide rail 20 is provided so as to extend in a direction normal to the extension of the first and second development lines L1, L2. A container holding table 10 for holding the film cartridge 1 (an example of a first film container) or the special magazine 2 (an example of a second film container) is slidable on the guide rail 20 in a direction indicated by the arrow H in FIG. 2. For example, table 10 is stopped in such a position by a click-stop mechanism 11 (see FIG. 7) formed by, e.g. a spring and a ball, that the center line thereof is located on the center line of the development line L1 or L2.

Further, the film detection sensors 107 are provided in the respective guide grooves 35 of the first and second development lines L1, L2 and in the vicinity of the film transport rollers 103. The APS film 3B having a narrower width may be mistakenly inserted into the development line L1 for the 135 size film. Accordingly, film detection sensors 107 are provided in two positions in the development line L1 for the 135 size film in order to prevent an erroneous insertion. Specifically, since the two film detection sensors 107 are simultaneously turned on only if the 135 size film 3A is properly inserted as shown in FIG. 3. The machine can detect when no film is inserted and when the APS film 3B is inserted. Therefore, the controller 500 drives the film transport roller 103 of the development line L1 for the 135 size film only when the two film detection sensors 107 are simultaneously on. Further, an aperture 106*a* through which the cutter 106 projects is provided in the development line L1 in order to cut the film 3A near its rear end.

The first and second development lines L1, L2 are adjacent to each other via a guide wall 21 (having a thickness G2). Widths of film insertion openings of the first and second development lines L1, L2 are set at values (substantially equal to W1, W2) which are widths W1, W2 of the respective films plus a slight margin, respectively. Accordingly, spacing S2 between the centers of the first and second development lines L1, L2 is determined by following equation (2):

$$S2=(W1+W2)/2+G2 \quad (2)$$

As described above, since W1<D1, W2<D2 and G1=G2, S2<S1 is shown by comparing equations (1) and (2). In other words, the position of the container holding table 10 is moved depending upon whether the 135 size film 3A is to be developed or the APS film 3B is to be developed. Therefore, as compared to the related art, the spacing S2 between the center lines of the first and second development lines L1, L2 can be made narrower, or substantially minimized.

There are special magazines 2 for the aforementioned 135 size film and for the 126 size film in addition to the one for the APS film. Since the width of the 126 size film is 35 mm, i.e. the same as the 135 size film, the 126 size film can be developed by the development line L1 for the 135 size film. Thus, various film containers can be stably held by the same container holding table 10 by setting the maximum dimensions of the respective portions of the special magazines 2 for the respective film substantially equal to that of the film cartridge 1 for the 135 size film.

Figure 8:
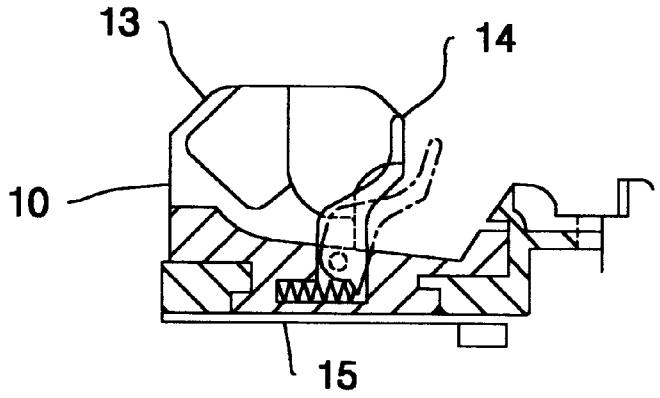
FIG. 8 is a view showing the configuration of the left wall of the container holding table.
Figure 9:
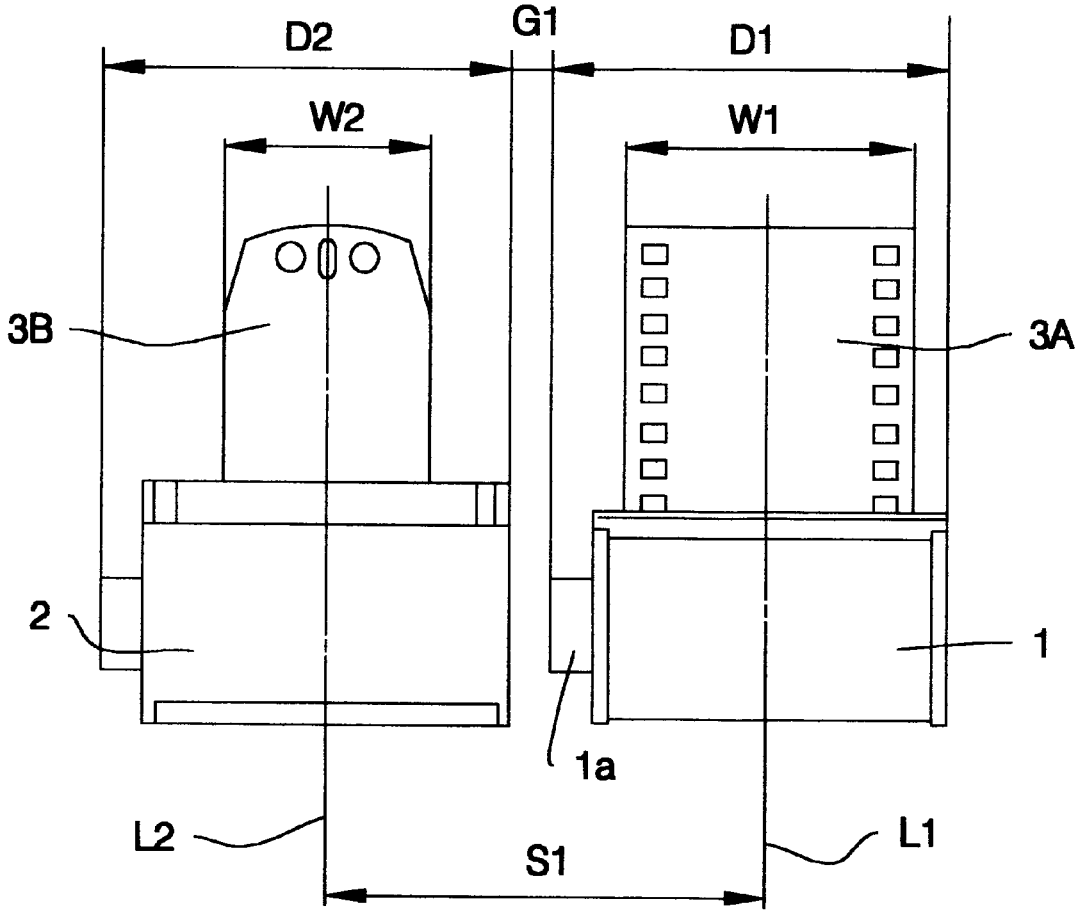
FIG. 9 is a view showing the spacing between center lines of the respective development lines when using a film cartridge for 135 size film and a special magazine for the APS film arranged side by side.

As shown in FIG. 2, the right wall 12 of the container holding table 10 is formed with a groove 12*a* for holding the special magazine for, e.g. the 126 size film by the engagement. Further, as shown in FIGS. 2 and 8, the left wall 13 of the container holding table 10 is provided with an arm 14 biased by spring 15. The arm 14 comes into contact with a part of the film cartridge 1 to restrain movement of the film cartridge 1.

The operation of the apparatus of this embodiment is described as follows. As shown in FIG. 3, when the 135 size film 3A is to be developed, a narrow leading end portion of the film 3A is cut in advance by the film end processing assembly 400 to make the width of the film 3A uniform. Further, the container holding table 10 is positioned and stopped by the click-stop mechanism 11 such that the center thereof is located on the center line of the first development line L1 for the 135 size film.

Next, with the outer and inner covers 101, 102 open, the film cartridge 1 is mounted in the container holding table 10 such that the emulsion surface of the film 3A faces the outside. At this time, it is assumed that the leading end of the film 3A is drawn by a specified length so as to reach the film transport roller 103. If the leading end of the film 3A is strongly curled (particularly, reverse curl in which the emulsion surface faces the outside), the film cartridge 1 tries to rotate due to the elasticity of the film 3A. However, since a part of the film cartridge 1 is restrained from moving by the aforementioned arm 14, the film cartridge 1 does not rotate and, conversely, the leading end of the film 3A is biased in such a direction as to straighten the curl.

If the inner cover 102 is closed in this state, the leading end of the film 3A is tightly held between the film transport roller 103 and the driven roller 104. Further, if the outer cover 101 is closed, it is locked by the cover locking mechanism 105, thereby preventing the inside of the outer cover 101, i.e. the film draw-out assembly 100, from being exposed to light. As a result, the film 3A can be drawn from the film cartridge 1. When a cover sensor (not shown) detects that the outer cover 101 has been closed, the controller 500 drives the film transport roller 103 to draw the film 3A from the film cartridge 1 and causes it to enter the film transport path 210 formed by the guide grooves 35, the transport rollers 36, etc.

If the special magazine 2 for the APS film is mistakenly mounted on the container holding table 10, the leading end of the APS film 3B does not pass through the detection areas of either sensor or only passes by one of the two film detection sensors 107. Accordingly, the controller 500 can distinguish whether the 135 size film 3A has correctly been mounted by comparing the outputs of the two film detection sensors 107. Unless the 135 size film 3A is correctly mounted, the controller 500 stops the drive of the film transport roller 103 and sounds an alarm.

Since the rear end of the 135 size film 3A is fixed to the spool of the film cartridge 1, the film 3A is held in a pulled state after the film 3*a* is almost entirely drawn from the film cartridge 1. This state is electrically or mechanically detected and the cutter 106 is activated to cut the film 3*a* near its rear end. After the passage of the rear end of the film 3A through the detection areas of the film detection sensors 107, output signals from the film detection sensors 107 change and, as a result, the controller 500 judges that the entire film 3A has been transported to the developing assembly 200.

Since the transport rollers 36 and 37 are provided at regular intervals along the film transport path 210 of the developing assembly 200 (FIG. 5), the film 3A is drawn from the film cartridge 1 and transported to the developing assembly 200 where it is developed while being transported through the respective treatment tanks 201 to 207 along the film transport path 210. The developed film 3A is transported to the drying assembly 300 and discharged from the apparatus after being dried.

When developing the APS film 3B, heat-pressing is applied in advance to the end portion of the film 3B drawn from the special magazine 2 by the film end processing assembly 400 to flatten it. Further, the container holding table 10 is positioned and stopped by the click-stop mechanism 11 such that the center thereof is located on the center line of the second development line L2 for the APS film.

Subsequently, with the outer and inner covers 101, 102 open, the special magazine 2 is mounted on the container holding table 10 such that the emulsion surface of the film 3B faces out. At this time, it is assumed that the leading end of the film 3B is drawn by a specified length so as to reach the film transport roller 103.

If the inner cover 102 is closed in this state, the leading end of the film 3B is tightly held between the film transport roller 103 and the driven roller 104 as in the case of the 135 size film. Further, if the outer cover 101 is closed, it is locked by the cover locking mechanism 105, thereby preventing the inside of the outer cover 101, i.e. the film draw-out assembly 100 from being exposed to light. Simultaneously, the lid of the special magazine 2 is opened, enabling the film 3B to be drawn from the special magazine 2. When the cover sensor (not shown) detects that the outer cover 101 has been closed, the controller 500 drives the film transport roller 103 to draw the film 3B from the special magazine 2 and causes it to enter the film transport path 210 formed by the guide grooves 35, the transport rollers 36, etc. If the film cartridge 1 for the 135 size film 3A is mistakenly mounted on the container holding table 10, the leading end of the film 3A cannot be inserted into the guide grooves 35 since the width of the 135 size film is larger than that of the APS film 3B. Therefore, the operator will notice the error.

Since the rear end of the APS film 3B is not fixed to a spool shaft of the special magazine, the film 3B is transported to the developing assembly 200 without being pulled even if the entire film 3B is drawn from the special magazine 2. After the passage of the trailing end of the film 3B through the detection area of the film detection sensor 107, an output signal from the film detection sensor 107 changes and, as a result, the controller 500 judges that the entire film 3B has been transported to the developing assembly 200. Subsequent developing and drying proceeds the same as in the case of the 135 size film.

Although the film cartridge 1 is used as a container for the 135 size film 3A in the foregoing embodiment, it is not limited to that. A special cartridge (not shown) used when the film cartridge 1 is broken may also be used. Although the 135 size film, the 126 size film and the APS film are described and illustrated as kind of films to be developed, it should be noted that the invention is applicable to commercially available film sizes or new film sizes which may be developed in the future.

As described above, the photographic film automatic developing apparatus according to the invention contains the first development line for drawing the first kind of film (e.g. 135 size film, 126 size film, etc.) from the first film container (film cartridge or special magazine) and developing it, and the second development line for drawing the second kind of film (e.g. APS film (1×240 size film), etc.) having a narrower width than the first kind of film from the second film container (special magazine) and developing it. At least the first and second development lines are arranged in parallel to each other and the first and second film containers are mounted on the common container holding table which is movable along a direction normal to the extension of the first and second development lines. Accordingly, the necessary spacing between the center lines L1, L2 of the first and second development lines can be minimized. As a result, the width (in a direction normal to a direction of transport of the film) of the developing apparatus can be made smaller. Further, dead space in the widthwise direction of the developing apparatus can be reduced, and the capacity of the respective treatment tanks and the amount of waste fluid during the development process can both be minimized.

Further, the container holding table has a click-stop mechanism so as to stop in a first position where the center line of the first kind of film contained in the first container is in alignment with the center line of the first development line and in a second position where the center line of the second kind of film contained in the second container is in alignment with the center line of the second development line. This makes it easier to position the container holding table and enables smooth film development even if the films to be developed include both the first and second kinds of film.

The first and second development lines contain film transport paths having guide grooves for guiding the opposite sides of the first and second kinds of film and film transport rollers for coming into contact with image recording areas of the first and second kinds of film to transport them in specified directions, respectively (see FIG. 6). Accordingly, the film can be securely transported to the development stage without using a leader.

Further, the first development line contains two film detection sensors for detecting the presence of the opposite sides of the first kind of film. Accordingly, even if a second kind of film (APS film, etc.) having a narrower width is mistakenly mounted in the fist development line for the first kind of film (135 size film, etc.), the erroneous mounting of the film can be detected since the two film detection sensors cannot simultaneously detect the side edges of the film.

Furthermore, by setting the maximum dimensions of the first and second film containers at least in the moving direction of the container holding table substantially equal to each other, the first and second film containers can be stably held by the container holding table.

The container holding table further contains a fixing member for fixing at least either one of the first and second film containers. According, movement of the film container due to the elasticity of the film can be minimized even if the ends of the films drawn from the respective film containers are curled.

What is claimed is:

1. A photographic film automatic developing apparatus, comprising:

a first development line having a first mechanism for drawing a first type of film from a first film container so that the first type of film can be developed;

a second development line having a second mechanism for drawing a second type of film having a narrower width than the first type of film from a second film container so that the second type of film can be developed, wherein at least the first and second development lines are arranged in parallel to each other; and a common container holding table being movable in a direction oblique to a direction of the first and second development lines, said first and second film containers being able to be mounted on said common container holding table.

2. A photographic film automatic developing apparatus as defined in claim 1, wherein said common container holding table is movable along a direction normal to the extension of the first and second development lines.

3. A photographic film automatic developing apparatus as in claim 1, wherein the container holding table comprises a click-stop mechanism to stop film in a first position where the center line of the first type of film contained in the first container is in alignment with the center line of the first development line and in a second position where the center line of the second type of film contained in the second container is in alignment with the center line of the second development line.

4. A photographic film automatic developing apparatus as in claim 1, wherein the first and second development lines comprise film transport paths comprising guide grooves for guiding opposite sides of the first and second types of film and film transport rollers for contacting image recording areas of the first and second types of film to transport them in specified directions.

5. A photographic film automatic developing apparatus as in claim 4, wherein the first development line comprises at least two film detection sensors for detecting the presence of the opposite sides of the first type of film.

6. A photographic film automatic developing apparatus as in claim 1, wherein maximum dimensions of the first and second film containers at least in the moving direction of the container holding table are substantially equal.

7. A photographic film automatic developing apparatus as in claim 1, wherein the container holding table comprises a fixing member for fixing at least one of the first and second film containers.

* * * * *